United States Patent [19]

Larigaldie et al.

[11] Patent Number: 4,525,140

[45] Date of Patent: Jun. 25, 1985

[54] IGNITION METHOD AND IGNITER DEVICE FOR IGNITING CARBURATED GASEOUS MIXTURES

[75] Inventors: Serge Larigaldie, Chatenay-Malabry; Gérard Labaune, Palaiseau, both of France

[73] Assignee: Office National d'Etudes et de Recherches Aerospatiales dit O.N.E.R.A., Chatillon, France

[21] Appl. No.: 333,272

[22] Filed: Dec. 22, 1981

[30] Foreign Application Priority Data

Dec. 29, 1980 [FR] France ..... 80 27717

[51] Int. Cl.[3] ..... H01T 300; F23Q 3/00

[52] U.S. Cl. ..... 431/258; 123/169 EL; 313/131 A

[58] Field of Search ..... 431/6, 258; 123/169 EL; 313/131 A, 594, 130, 143, 586; 361/247; 60/39.827

[56] References Cited

U.S. PATENT DOCUMENTS

| | | | |
|---|---|---|---|
| 2,208,668 | 7/1940 | Devine | 123/169 EL |
| 2,605,754 | 8/1952 | Smits | 313/131 A |
| 2,745,980 | 5/1956 | Smits | 313/131 A |
| 2,881,703 | 4/1959 | Volpert | 361/253 X |
| 3,439,995 | 4/1969 | Hattori | 361/253 X |
| 3,581,141 | 5/1971 | Beaubier | 313/130 |
| 3,974,412 | 8/1976 | Pratt, Jr. | 313/131 R |
| 4,007,391 | 2/1977 | Baker | 313/131 A |
| 4,081,710 | 3/1978 | Heywood et al. | 123/169 EL |
| 4,092,558 | 5/1978 | Yamada | 313/143 X |
| 4,142,121 | 2/1979 | Carpenter | 313/131 A |
| 4,264,844 | 4/1981 | Axe et al. | 313/131 A |
| 4,337,408 | 6/1982 | Sone et al. | 313/131 A |
| 4,418,300 | 11/1983 | Otanic et al. | 313/594 |

FOREIGN PATENT DOCUMENTS

| | | | |
|---|---|---|---|
| 1540265 | 9/1968 | France . | |
| 2323253 | 1/1977 | France . | |
| 22517 | 9/1910 | United Kingdom | 313/131 A |

*Primary Examiner*—Samuel Scott
*Assistant Examiner*—Carl D. Price
*Attorney, Agent, or Firm*—Lowe, King, Price & Becker

[57] ABSTRACT

A flash-spark creeps on a dielectric surface to ignite carburated gaseous mixtures. A high voltage pulse is applied through the dielectric between opposite surfaces thereof. The voltage is applied between a first electrode having a smaller area abutting against a first surface of the dielectric and a second electrode having a first strip portion abutting against an opposite second surface of the dielectric and a second portion which is astride an edge of the dielectric. The strip portion ends at a position beneath the first electrode. The first surface is exposed to the carburated gaseous mixture.

4 Claims, 7 Drawing Figures

FIG. 5a
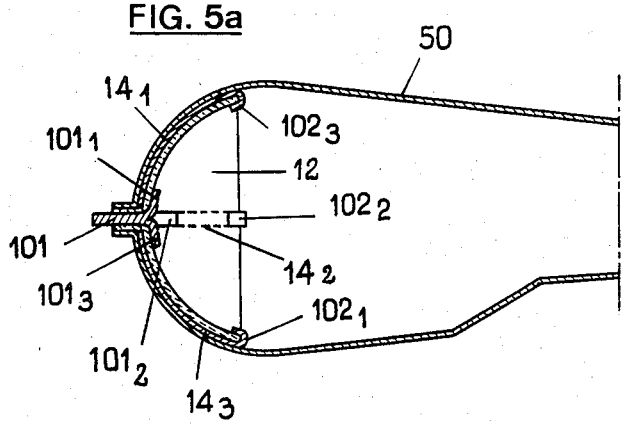
FIG. 5b
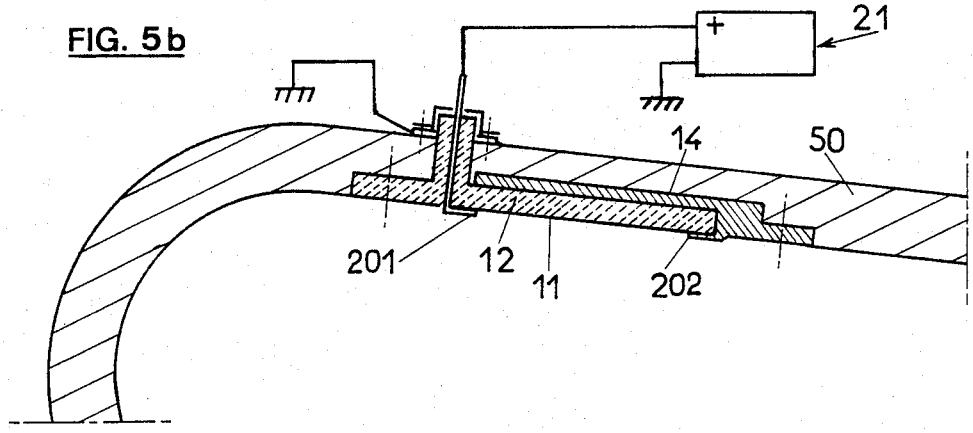
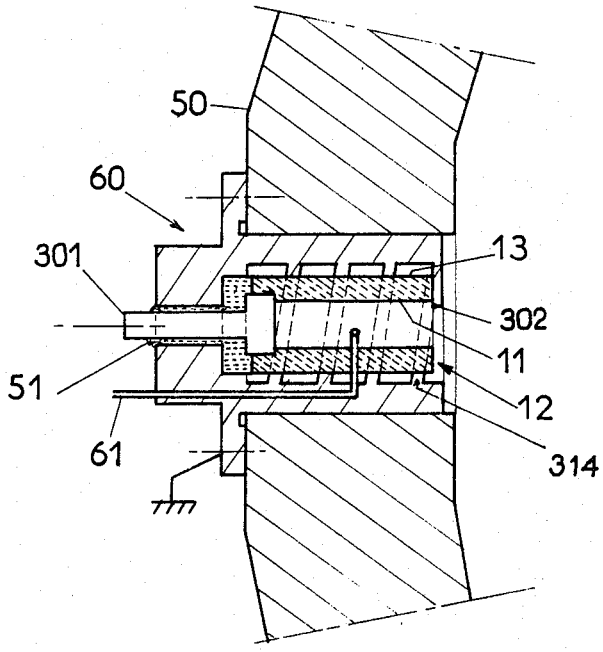
FIG. 6

IGNITION METHOD AND IGNITER DEVICE FOR IGNITING CARBURATED GASEOUS MIXTURES

BACKGROUND OF THE INVENTION

1. Field of the Invention

The invention relates to ignition by electric spark plugs of gaseous carburated mixtures used in internal combustion engines, evaporated fuel burners of industrial boilers, gas turbines and ramjets, and more particularly to creeping discharge spark plugs of the flash-spark type in which the spark creeps over the surface of an insulator to ignite a mixture of gases in a combustion chamber.

One method of electrical ignition involves initiating an electric spark at an appropriate moment in a gaseous medium under certain conditions to achieve ignition and to maintain combustion.

As a general rule, the spark is provoked between two electrodes separated by a gap of substantially 0.6 mm, depending on the sparking conditions. Ignition of the mixture is initiated by a cylindrical plasma forming a length equal to that of the gap between the electrodes. The plasma liberates energy by thermal conductivity and radiation and diffuses activated particles. These two actions are conductive to ignition of the carburated gas mixture and propagation of the flame.

Because of the relatively small dimensions of the plasma, the mixture volume affected by the ignition is small compared to the total volume of gas to be ignited. This results in the well-known difficulties of ignition that occur because (1) the richness of the mixture to be ignited is very different from the stoichiometric mixture and (2) the gaseous mixture is not sufficiently locally homogeneous and (3) the plasma created has small dimensions, whereby the richness of mixture zones is very different from stoichiometric proportions.

It is known that elongation of the spark leads to higher amounts of liberated energy that is transmitted by heat conduction of the gaseous medium; spark elongation also causes higher radiation intensity and higher ionized particle density.

2. Description of the Prior Art

Attempts have been made for a considerable time to extend the electrical ignition spark to increase the probability of finding spark or plasma mixture zones that approach the stoichiometric ratio, thus enabling a high performance and reliable ignition procedure to be obtained. In certain spark elongation methods the gap between the electrodes is increased and an element inserted between electrodes acts as a relay for the spark.

French Pat. No. 1 540 265 describes such a device in which an intermediate metallic element, acting as relay for the spark, is located half-way along the gap between the electrodes. The element is electrically insulated from the electrodes and carried by an insulator endowed with good thermal conductivity. The total length of the spark produced attains 1.2 mm in this way.

In French Pat. No. 2 323 253, which concerns a plasma igniter for a gas turbine engine, the element inserted between the two electrodes outer surface of the bar except for a longitudinal strip connecting the two spark establishing electrodes, is insulated from the gaseous mixture by an enamel coating. It is believed that the semiconductor bar causes local preheating of the mixture to be ignited, whereby the density of the gas drops locally, thus making it easier for the spark to jump.

In U.S. Pat. No. 3,974,412 is disclosed another method for creating an unusually long arc discharge having an electronically controlled length and disposition.

According to this Patent, a spark plug comprises, in combination, a high voltage electrode that extends axially outward from the base of the spark plug. An insulating jacket covering the high voltage electrode extends continuously from the base of the plug to the region of the free end of the high voltage electrode. The free end of the high voltage electrode is exposed and formed to have a sparking surface oriented at an angle to the axially extending part of the high voltage axial electrode. A electrode extending from the body of the spark plug to the vicinity of the insulating jacket on the high voltage electrode has a sparking surface oriented at an angle to the axis. A separation between the ground electrode and the high voltage electrode through the insulating jacket is much less than the gap between the sparking surface of the ground electrode and the sparking surface of the high voltage electrode. The sparking surface of the electrodes is properly tapered such that an arc formed in an operating spark plug follows a curved path meeting each tapered sparking surface along a direction such that the discharge bends away from the axially extending part. The arc extends in an outward radial direction away from the axially extending part to distribute the arc energy and temperature. According to the teaching of this Patent non-creeping spark arcs having a maximum strength of 1 cm long are obtainable.

The object of the present invention is to provide relatively long flash sparks of say several cms. or tens of cms. long.

A further object of the invention is to provide an arc having a path complying with any arbitrarily defined pattern.

A further object of the invention is to ensure electrical ignition of a carburated gas mixture, even if this mixture is very lean and heterogeneous in space and time.

The invention provides means for obtaining a spark considerably greater in length then sparks previously obtained, rendering it possible by causing this spark to slide on a high resistivity dielectric surface. The spark can have any shape conductive to ready ignition of the mixture, regardless of the configuration and type of the combustion chamber.

SUMMARY OF THE INVENTION

A spark discharge device having a controlled discharge path between first and second spaced points includes first and second electrodes spaced from each other by a solid dielectric having first and second opposed surfaces and an edge between the surfaces. The second and first surfaces are and are not respectively exposed to carburated gases to be ignited along the discharge path. The first electrode includes portions astride the edge and in contact with the second surface at the second point. The first electrode also has an elongated path on the first surface corresponding with the discharge path between the first and second points. The second electrode has a small discharge area into the dielectric relative to the area of the elongated path along the dielectric. The small area is positioned so it is aligned with the first point. A pulsed discharge voltage is applied between the electrodes so that a discharge is established on the second surface between the first and second points along a path corresponding with the path of the first electrode elongated path portion.

BRIEF DESCRIPTION OF THE DRAWING

The invention is henceforth described with reference to the accompanying drawing in which:

FIGS. 5*a* and 5*b* are examples of application of the invention to the wall of a combustion chamber; and FIG. 6 is another example of an application of the invention to a plasma igniter installed inside a turbojet combustion chamber.

DESCRIPTION OF THE PREFERRED EMBODIMENT

Figure 1:
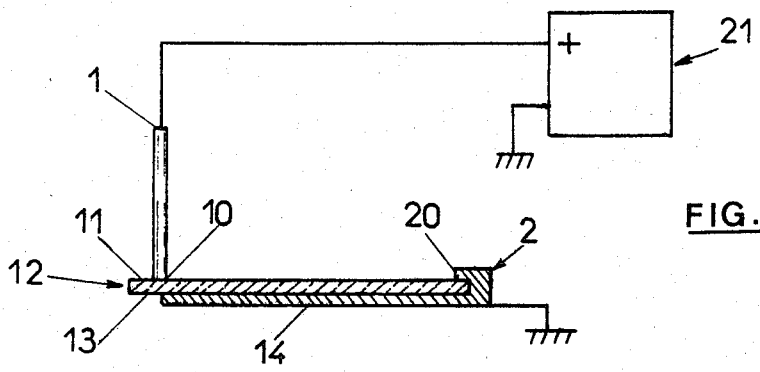
FIG. 1 is a diagrammatic representation of a flash spark plug in accordance with the invention.
Figure 2:
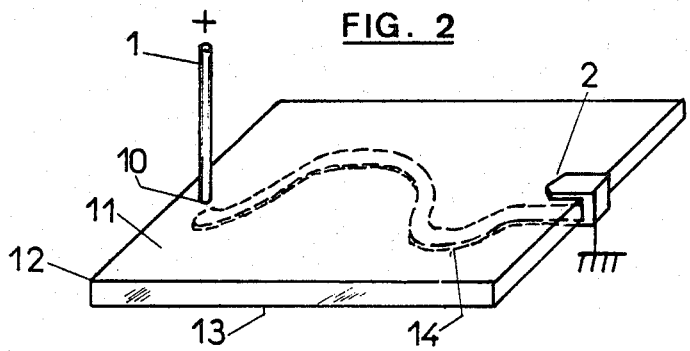
FIG. 2 is a perspective view in accordance with FIG. 1.

On diagrammatic FIGS. 1 and 2, a first cylindrical electrode 1 is connected to a high level pulsed voltage generator producing, for instance, 30,000 volts. Bottom end 10 of electrode 1 abuts against upper surface 11 of dielectric plate 12. A second, grounded electrode 2, at the edge of the dielectric plate, has a tip 20 situated above the surface of the dielectric. Electrodes 1 and 2 are connected to opposite electrodes of a high voltage generator assembly 21. Metal blade 14 of electrode 2 extends over bottom face 13 of dielectric plates 2 to a region beneath electrode 1; the configuration of blade 14 corresponds to the path that is intended to cause the spark to follow.

Figure 3:
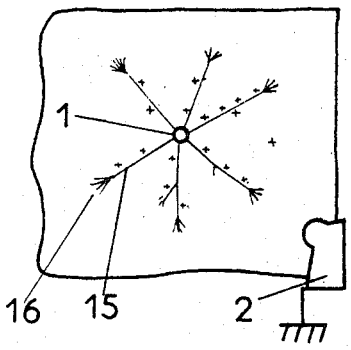
FIG. 3 is a top view of FIG. 1 illustrating the electrical discharge mechanism.

In FIG. 3 is shown the pattern of an electrical discharge over a dielectric surface. The voltage of electrode 1 is increased from 0 to several tens of thousands of volts, preferably within a few microseconds, i.e. relatively slowly. The electric field created in the area around end 10 of electrode 1 becomes very extensive and produces local ionization of a gaseous mixture. Raising the voltage causes formation of several small highly ionized conductive vertical filaments which rapidly grow with the rise in voltage. At ends of the filaments are multiple shorter diverting branch filaments equivalent to a cold corona discharge. Current flows in the filaments 15 and the filament temperature rises. Since filaments 5 are conductive, the electric field is shifted to head 16 of the short filaments which deposit positive charges on the surface of dielectric plate 11. At the end of the process, one of the ionized filaments 15 encounters grounded electrode 2, thus short-circuiting the electric generator 21, which is protected by a series resistor. Consequently, a very intense current wave flows in the ionized filament from electrode 2 toward electrode 1 causing the ionized filament to be considerably heated. The thus established transient arc receives almost all the avaiable energy and can hence be set up over practically any length.

However, this mechanism is only slightly satisfactory since in most cases only one of the created filaments contacts electrode 2; the other, very numerous filaments, which are randomly directed unnecessarily consume part of the energy available.

This is why grounded electrode 2 is provided with an extension in the form of a metal blade 14 or wire or layer laid a small distance from the bottom face of dielectric plate 13 on which the spark forms, whereby only useful desired filaments having predetermined paths of any desired configuration are formed through dielectric material 11.

Figure 4:
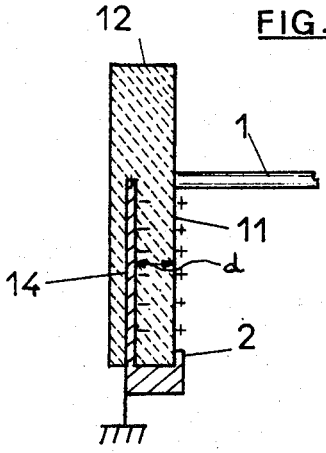
FIG. 4 is a cross-sectional variant of the plug of Fig. 1 in accordance with the invention.

FIG. 4 is a drawing of an alternative arrangement of FIGS. 1 and 2 wherein electrode 2 includes spark forming metal blade 14 that is inserted into dielectric plate 12 so it is parallel to and spaced from face 11 by distance d. The positive charges deposited on the face 11 by filaments 15 and the negative charges engendered by the extension 14 of the electrode 2 are shown, ensuring that an electric field subsists in dielectric plate 12 between the extension and face 11.

As illustrated in FIG. 5*a*, a combustion chamber responsive to the arc includes a hemispherical wall having an inner face on which are deposited three curved metal strips $\mathbf{14_1}$, $\mathbf{14_2}$, and $\mathbf{14_3}$, shaped as meridional lines on a sphere. Strips $\mathbf{14_1}$, $\mathbf{14_2}$, and $\mathbf{14_3}$, which form electrodes $\mathbf{102_1}$, $\mathbf{102_2}$, $\mathbf{102_3}$, are angularly spaced apart by 120° and folded around the edge of ceramic coating 12 which covers the metal strips. The electrode 101 has three projection branches radially aligned with electrodes $\mathbf{102_1}$, $\mathbf{102_2}$, $\mathbf{102_3}$. The resulting spark has a star shaped configuration.

The device in accordance with the invention is installed on the side wall of the combustion chamber or turbojet as illustrated in FIG. 5*b*. The metal wall 50 of the combustion chamber is machined to form a cavity for housing the igniter. A very long spark is formed on wall 50. The igniter includes electrodes 201 and 202 respectively raised to a high voltage level by a pulse derived from generator 31, and grounded by virtue of being secured to wall 50 connected to the ground terminal of the pulse generator 21. The igniter includes dielectric plate 12, having surface 11 for forming the spark. Electrode 202 includes extended metal guide 14, spaced from and parallel to surface 11. Guide 14 is formed as a thin rectilinear blade enabling a spark to propagate in a straight line over several tens of centimeters on surface 11 of dielectric plate 11.

FIG. 6 is an illustration of another turbojet or ramjet injection type igniter. The igniter of FIG. 6 includes metal body 60 that is secured to wall 50 of the combustion chamber. Electrode 301 is housed axially in the igniter inside of cylindrical insulator 51 by a known technique. At one end of electrode 30, tube 12 rests on grounding electrode 302. Conduit 61, enabling small quantities of combustible fuel to be introduced into the igniter, leads to the gap between electrodes 301 and 302.

The spark is formed on internal surface 11 of dielectric tube 12. The outer surface 13 of dielectric tube 12 is supported on helical shoulder 314, machined into igniter body 60. Shoulder 314 guides the spark in a helical path since the shoulder induces the spark to spread over internal surface 11 of dielectric tube 12.

The dielectric materials used to implement the invention are selected from those available to the specialist in accordance with the methods of implementation specific to the invention. For instance, alumina-based ceramic compositions or any equivalent material can be used provided the requisite high resistivity of at least $10^{10}$ ohms. cm, and preferably greater than $10^{12}$ ohms. cm is attained.

Depending on the particular case, the dielectric element can be formed as a unitary assembly with the grounded electrode and its metal extension. Such an assembly can be secured to the combustion chamber wall.

Contrarywise, it is possible in certain cases to form all the parts of the assembly directly on the wall using spray or sputtering deposit techniques, for instance a plasma torch can be used to deposit both the dielectric and the metal extension of the grounding electrode.

As suggested by the description, the invention can be applied with advantage to all cases in which gaseous carburated mixtures are to be ignited, regardless of the type and conformation of the combustion chamber.

In one preferred embodiment, a plug of the invention is formed as a 0.1 mm thick dielectric plate having a resistivity of $10^{10}$ ohm. cms; the plate is fed by a 30 kV voltage pulse that ignites a 3 cms spark in a gas having pressure of 10 atmospheres. Prior art plug sparks do not significantly exceed the Paschen's law value of 0.1 cm.

Although only two shapes of creeping sparks have been disclosed in the foregoing, namely a divergent multibranch spreading spark and a single branch helical creeping spark, every desired spark configuration can be implemented according to the invention. Particularly parallel multibranch sparks originating at a common active electrode and terminating at a common ground electrode can be readily built up. As an example, such a spark can comprise a first rectilinear branch, a second V-shaped branch and a third inverted V-shaped branch: ϕ.

What we claim is:

1. A spark discharge device having a controlled discharge path between first and second spaced points comprising first and second electrodes spaced from each other by a solid dielectric having first and second opposed surfaces and an edge between said surfaces, the second surface being positioned to be exposed to carburated gases to be ignited along the discharge path, the first surface being positioned so it is not exposed to the carburated gases, the first and second electrodes being respectively fixedly positioned on the first and second surfaces, the first electrode including a portion astride said edge at the second point and including a portion folded on and in contact with the second surface at the second point, the first electrode further having an elongated path portion disposed on said first surface extending to said first point and defining the discharge path between the first and second points, the second electrode having a small discharge area into the dielectric relative to the area of the elongated path portion along the dielectric, the small area being positioned so it is aligned with the first point, and means for applying a pulsed discharge voltage between the electrodes so that a discharge is established on the second surface between the first and second points along a path corresponding with the path of the first electrode elongated path portion.

2. A spark discharge device of claim 1, further including means for supplying a carburated gaseous mixture to be ignited by the discharge to the second surface.

3. A spark discharge device of claim 1, wherein the dielectric comprises a solid plate having first and second parallel faces on which said elongated path portion and second electrode are respectively located.

4. A spark discharge device of claim 3, further including means for supplying a carburated gaseous mixture to be ignited by the discharge to the second face.

* * * * *